US006438904B1

(12) United States Patent
Anzai et al.

(10) Patent No.: US 6,438,904 B1
(45) Date of Patent: Aug. 27, 2002

(54) ROOT WRAPPING TYPE ASEISMIC REINFORCEMENT CONSTRUCTION AND METHOD FOR BASE OF COLUMN MEMBER

(75) Inventors: Hajime Anzai, Niigata Pref.; Haruma Asakawa, Tokyo; Tomomichi Nakamura, Hyogo-ken; Shigeru Ochiai, Tokyo, all of (JP)

(73) Assignees: Mitsubishi Heavy Industries, Ltd., Tokyo (JP); Nihonkai LNG Co., Ltd., Kitakanbara-gun (JP); Jonquil Consulting Inc., Tokyo (JP)

( * ) Notice: Subject to any disclaimer, the term of this patent is extended or adjusted under 35 U.S.C. 154(b) by 0 days.

(21) Appl. No.: 09/676,990

(22) Filed: Oct. 2, 2000

(30) Foreign Application Priority Data

Dec. 17, 1999 (JP) ..... 11-359543

(51) Int. Cl.[7] ..... E04B 1/98

(52) U.S. Cl. ..... 52/167.1; 61/53; 52/296; 189/29

(58) Field of Search ..... 52/167.1, 292, 52/299, 296, 297

(56) References Cited

U.S. PATENT DOCUMENTS 3,193,059 A * 7/1965 Wallerstein, Jr. ..... 189/29
3,916,635 A * 11/1975 Lynch et al. ..... 61/53
5,505,033 A * 4/1996 Matsuo et al. ..... 52/296

FOREIGN PATENT DOCUMENTS

| | | |
|---|---|---|
| EP | 0 861 945 | 9/1998 |
| FR | 2 680 809 | 3/1993 |
| JP | 3-41067 | 4/1991 |
| JP | 9-59934 | 3/1997 |
| JP | 10-018424 | 1/1998 |
| JP | 10-331437 | 12/1998 |
| JP | 11-036660 | 2/1999 |
| JP | 11-117541 | 4/1999 |
| JP | 11-210079 | 8/1999 |

* cited by examiner

*Primary Examiner*—Carl D. Friedman
*Assistant Examiner*—Steve M Varner
(74) *Attorney, Agent, or Firm*—Oblon, Spivak, McClelland, Maier & Neustadt, P.C.

(57) ABSTRACT

The present invention provides a root wrapping type aseismic reinforcement construction and method for a base of a column member. A buffering portion is provided between the base of the column member and a root wrapping member to decrease bending moment generated on the base by an external force. Therefore, the bending moment is less prone to be transmitted to a foundation member, so that the bending moment born by the foundation can be reduced.

15 Claims, 10 Drawing Sheets

FIG. 9

| TEST NO. | TEST CONDITIONS | | |
|---|---|---|---|
| | EXCITATION WAVEFORM | EXCITATION LEVEL (G) | DIRECTION OF EXCITATION |
| 4 | ELCENTRO WAVE | 0.3 | X |
| 5 | | 0.6 | |
| 6 | | 0.9 | |
| 7 | | 0.3 | Y |
| 8 | | 0.6 | |
| 9 | | 0.9 | |
| 10 | | 0.9 – 1.4 | X – Z |
| 11 | | 0.9 – 1.4 | Y – Z |
| 12 | ON-SITE OBSERVED SEISMIC WAVE | 0.9 | X |
| 13 | | 0.9 | Y |

ROOT WRAPPING TYPE ASEISMIC REINFORCEMENT CONSTRUCTION AND METHOD FOR BASE OF COLUMN MEMBER

BACKGROUND OF THE INVENTION AND RELATED ART STATEMENT

1. Field of the Invention

The present invention relates to a root wrapping type aseismic reinforcement construction and method for a base of a column member.

2. Description of Related Art

Various aseismic reinforcement methods for increasing resistance to earthquake have been studied on existing buildings, civil engineering structures, and other structures, which were built in conformity with the old seismic design standards, by making good use of our experience in great earthquakes gained by, for example, superhighways destroyed by the Great Hanshin Earthquake and by assuming a case where an earthquake greater than the previous one occurs. For example, as an aseismic reinforcement method for steel framed reinforced concrete structures, there have been proposed a method in which reinforcing bars are wrapped around a column member and concrete is placed to increase the resistance of the column member, a method in which a steel plate is wrapped around a column member, and a method in which a carbon fiber sheet or the like is wrapped around the whole outer peripheral surface of a column, which has been disclosed in Japanese Patent Provisional Publication No. 11-117541 (No. 117541/1999).

For plant structures such as liquefied natural gas (LNG) storing facilities, although the plant structures were not damaged fatally by the Great Hanshin Earthquake, there occurred damage such as broken pipelines for energy transportation and dropped beds for supporting the pipelines. Therefore, a review of seismic diagnosis for a column base of a bed for piping system has been made, and an aseismic reinforcement method therefor has been studied.

In this case, various methods are possible as a method for improving a column member of an existing structure to provide an aseismic reinforcement construction. For example, a method in which a column base and foundation are reinforced extensively is possible. However, the aseismic reinforcement of foundation has a disadvantage that the work is complicated, so that a long term of work and a high cost are required.

On the other hand, a method in which a column base etc. exposed above the ground are reinforced without the extensive reinforcement of foundation has an advantage that necessary and sufficient earthquake-resistant performance can be provided, and the work is simple, so that the work can be performed in a short period of time.

As an example of this aseismic reinforcement method, Japanese Patent Provisional Publication No. 10-331437 (No. 331437/1998) has disclosed a method in which a reinforcement metal is joined at a position where an existing beam and column are joined on a steel column of an existing steel structure to increase the shearing strength and bending strength of the beam-column joint.

Also, Japanese Patent Provisional Publication No. 10-18424 (No. 18424/1998) has disclosed a method in which reinforced concrete is wrapped in the vicinity of the lower end of a steel column as a reinforcement method for a steel column base on a structure for connecting the steel column to the foundation.

The following is summarization of problems arising when the concept of the above-described aseismic reinforcement method for a column base is applied to a bed for piping system with a construction in which one steel column member is arranged on one pile foundation.

The conventional concept of the aseismic reinforcement for a bed for piping system is that letting a be the stress applied to the foundation by a seismic force, f be the allowable stress of foundation, and $\sigma/f$ be the allowable unit stress, a column and a beam are reinforced with a cover plate so that the allowable unit stress ($\sigma/f$) obtained by the cross-section calculation is lower than 1, by which the rigidity is increased so that the structure can withstand a seismic force exceeding that at the time of design.

On the other hand, the aseismic reinforcement of a column base has been effected by wrapping reinforced concrete around the base to reduce an effect on the foundation and to prevent a base plate from buckling. The design concept for the column base of the bed for piping system is as described below, assuming that the method for supporting the column base by means of the foundation is premised on a pin condition.

Specifically, 1) an anchor bolt connecting the steel column base to the foundation bears an axial force and shearing force, 2) the foundation member bears an axial force from the anchor bolt and bending moment caused by the shearing force, and 3) the base plate bears a tensile force and bending moment caused by the anchor bolt and pushing and withdrawing caused by the column.

Therefore, if the steel column base is rigidly connected to the foundation by joining the reinforcement metal to the beam-column joint at the lower end of the steel column or by wrapping reinforced concrete as the reinforcement method for the steel column base, the method for supporting the column base by means of the foundation changes from the pin condition to a fixed condition, so that the shearing force and bending moment are transmitted to the foundation via an interface at which the reinforcement metal or the reinforced concrete comes newly into contact with the column base. Since the shearing force and bending moment transmitted to the foundation increase in correlation with the magnitude of the seismic force when the seismic force increases, in the case where the steel column base is rigidly connected to the foundation, if the allowable unit stress is exceeded, the foundation itself cannot withstand the stress, and may be broken.

In the conventional foundation strength design, however, although a sufficient safety factor for the axial force is secured, the safety factor for the bending moment actually does not have an enough margin as compared with that for the axial force. Therefore, it is found that although the aseismic reinforcement in which the cover plate is put on the column and beam is suitable for the case where the allowable stress of the foundation has some degree of margin, the aseismic reinforcement in which the column and beam are simply reinforced with the cover plate is unsuitable for the case where design is made so that the allowable stress of the foundation has a small margin.

OBJECT AND SUMMARY OF THE INVENTION

The present invention has been made to solve the above problems with the related arts, and accordingly an object thereof is to provide a root wrapping type aseismic reinforcement construction and method in which a buffering portion is provided between a base of a column member and a root wrapping member to decrease bending moment generated on the base by an external force, and therefore the bending moment is less prone to be transmitted to a foundation member, so that the bending moment born by the foundation member can be reduced.

To achieve the above object, the root wrapping type aseismic reinforcement construction in accordance with the present invention is configured as described below. Specifically, the root wrapping type aseismic reinforcement construction in which a base of a column member erected on a foundation member is reinforced with a root wrapping member comprises a buffering portion provided between the base of the column member and the root wrapping member.

Preferably, the buffering portion is a clearance provided between the column base and the root wrapping member.

Preferably, the buffering portion is a clearance provided between the column base and the root wrapping member and further filled with a filler.

Preferably, the root wrapping member and the filler regulate bending moment generated when the column member is deformed.

Preferably, the filler is either an elastically deformed material including vibration proof rubber or an elastic element including a spring.

Preferably, the filler is either a plastically deformed material including either a metallic material or a metallic alloy or a plastically deformed structural element.

Preferably, the root wrapping member is a reinforced concrete root wrapping member formed by placing reinforced bars at the outer periphery of the column base and the upper end portion of the foundation member, by placing outer winding hoops at the outer periphery of the reinforcing bars, and by placing concrete in a space within the outer winding hoops.

Preferably, a bend constraining force caused on the column base by an external force is relieved, and bending moment generated on the column base is regulated, thereby reinforcing the foundation member.

Also, the root wrapping type aseismic reinforcement method in accordance with the present invention comprises the steps as described below. Specifically, the root wrapping type aseismic reinforcement method in which a base of a column member erected on a foundation member is reinforced with a root wrapping member comprises a buffering step of regulating bending moment generated on the base of the column member by the application of an external force to the column member at a portion between the base and the root wrapping member, and a regulating step of further regulating the bending moment by absorbing the bending moment regulated in the buffering step.

Also, according to the present invention, the root wrapping type aseismic reinforcement method in which a base of a column member erected on a foundation member is reinforced with a root wrapping member comprises a clearance forming material providing step of providing a forming material for forming a clearance at the outer periphery of the base facing the root wrapping member; a fixing step of placing reinforcing bars at the outer periphery ranging from the base of the column member to the upper end portion of the foundation member, placing outer winding hoops at the outer periphery of the reinforcing bars, and fixing the reinforcing bars to the upper end portion of the foundation member; a member forming step of placing concrete in a space within the outer winding reinforcing bars fixed in the fixing step to form a reinforced concrete root wrapping member, including the forming material provided in the clearance forming material providing step; and a clearance forming step of forming a clearance by removing the forming material from the reinforced concrete root wrapping member formed in the member forming step.

Preferably, the root wrapping type aseismic reinforcement method further comprises a filling step of filling the clearance formed in the clearance forming step with a filler.

As described above, according to the root wrapping type aseismic reinforcement construction and method for the column member erected on the foundation member in accordance with the present invention, the buffering portion is provided between the base of the column member and the root wrapping member to decrease the bending moment generated on the base by an external force, and therefore the bending moment is less prone to be transmitted to the foundation member, so that the bending moment born by the foundation member can be reduced.

BRIEF DESCRIPTION OF THE DRAWINGS

FIG. 9 is a table giving seismic test conditions; and

DETAILED DESCRIPTION OF PREFERRED EMBODIMENTS

An embodiment of an aseismic reinforcement construction will now be described with reference to the accompanying drawings.

Figure 1A:
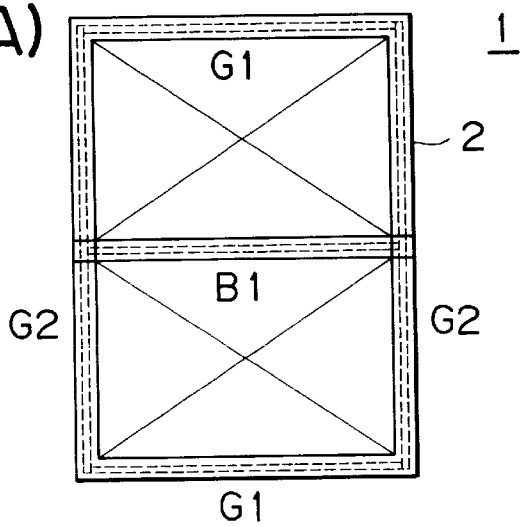
FIG. 1 is a general construction view of a bed for piping system before being reinforced in accordance with an embodiment, FIG. 1(A) being a plan view of the bed for piping system formed of steel columns, FIG. 1(B) being a front view thereof, and FIG. 1(C) being a side view thereof.
Figure 1B:
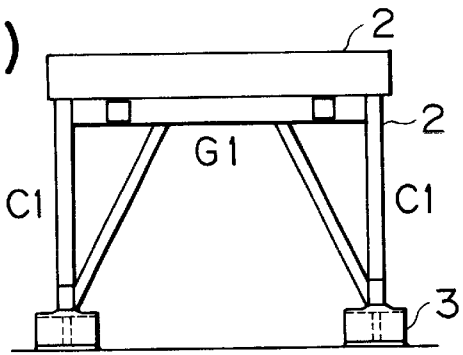
Figure 1C:
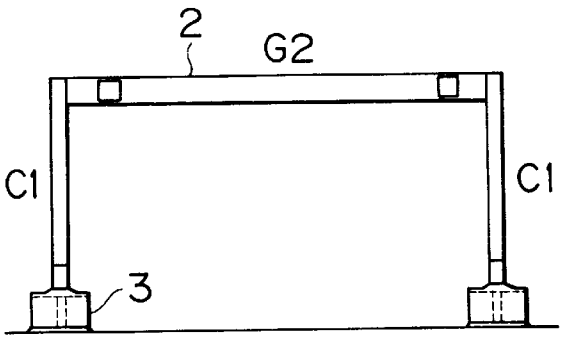

FIG. 1 is a general construction view of a bed 1 for piping system before being reinforced in accordance with this embodiment. FIG. 1(A) is a plan view of the bed 1 for piping system formed of steel columns 2 (for example, H sections) which is viewed from the top, FIG. 1(B) is a front view of the bed 1 for piping system which is viewed from the front, and FIG. 1(C) is a side view of the bed 1 for piping system which is viewed from the side. The steel columns 2 are erected on a foundation 3 as shown in FIG. 1(B).

Figure 2:
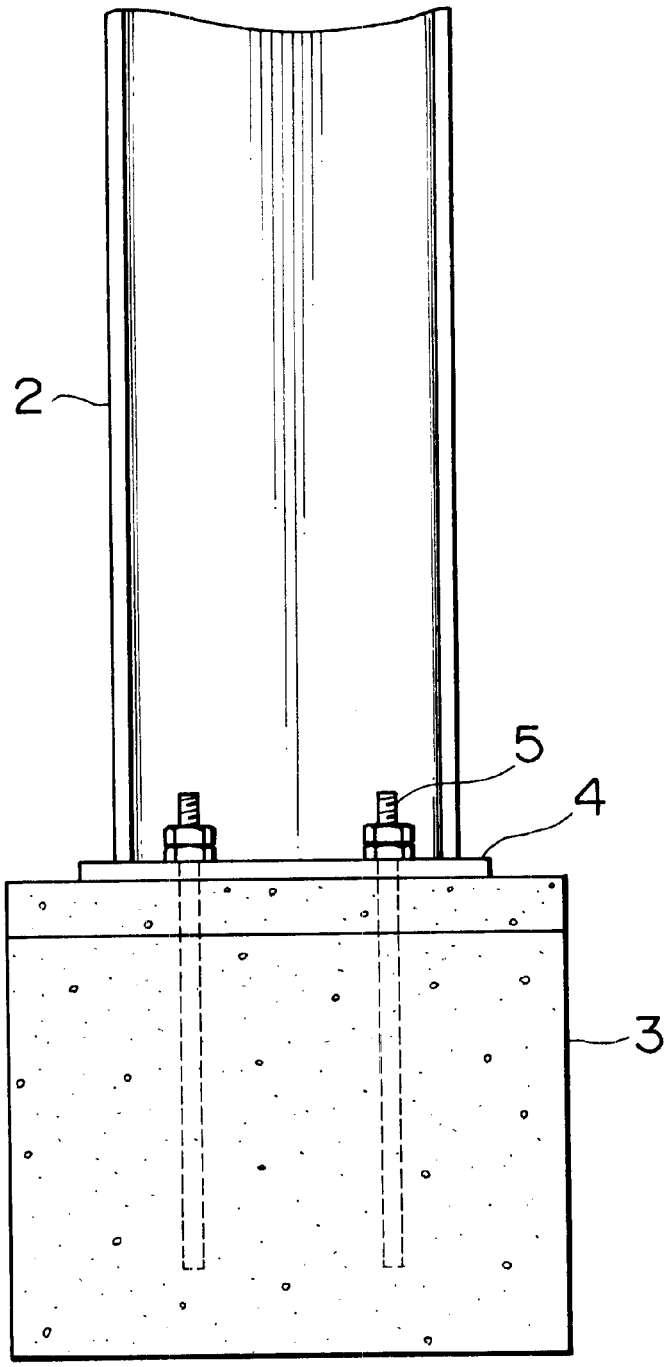
FIG. 2 is an enlarged front view of a lower end portion of a column base of a bed piping system.
Figure 3:
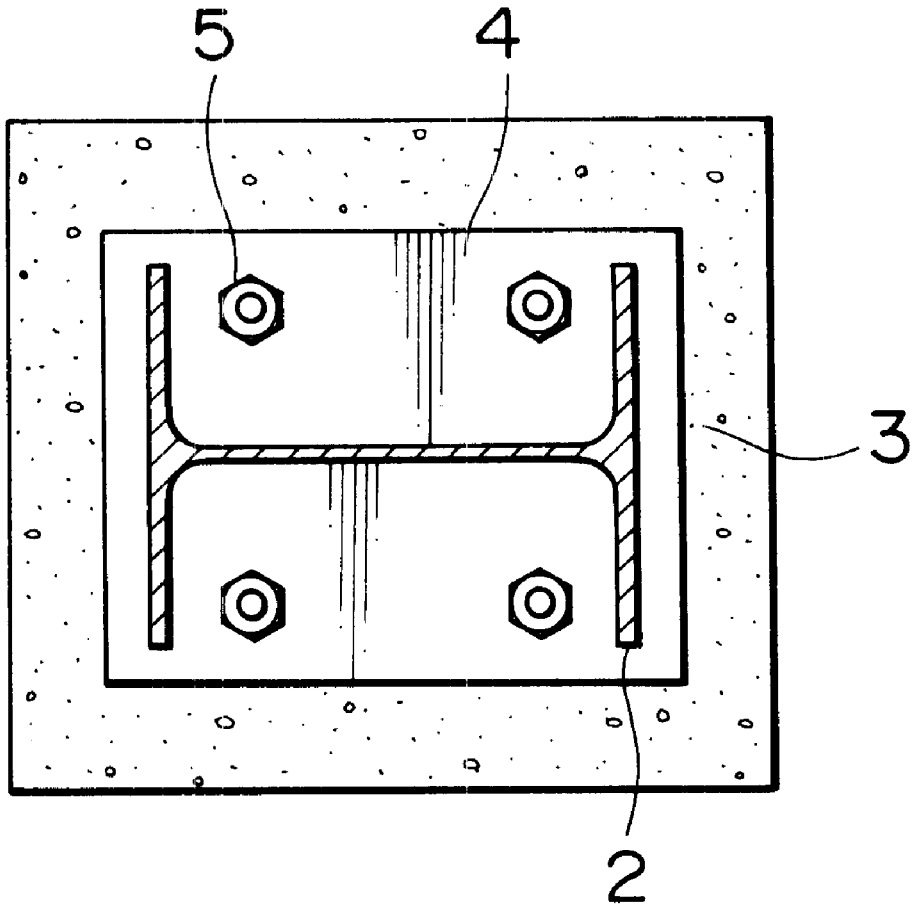
FIG. 3 is an enlarged sectional view of a lower end portion of a column base of a bed for piping system.

FIG. 2 is an enlarged front view of a lower end portion of a column base of the bed 1 for piping system, and FIG. 3 is an enlarged sectional view of a lower end portion of the column base of the bed 1 for piping system. As can be seen in FIGS. 2 and 3, the steel column 2 is welded to a base plate 4, and is connected to the foundation 3 by using anchor bolts 5.

Figure 4:
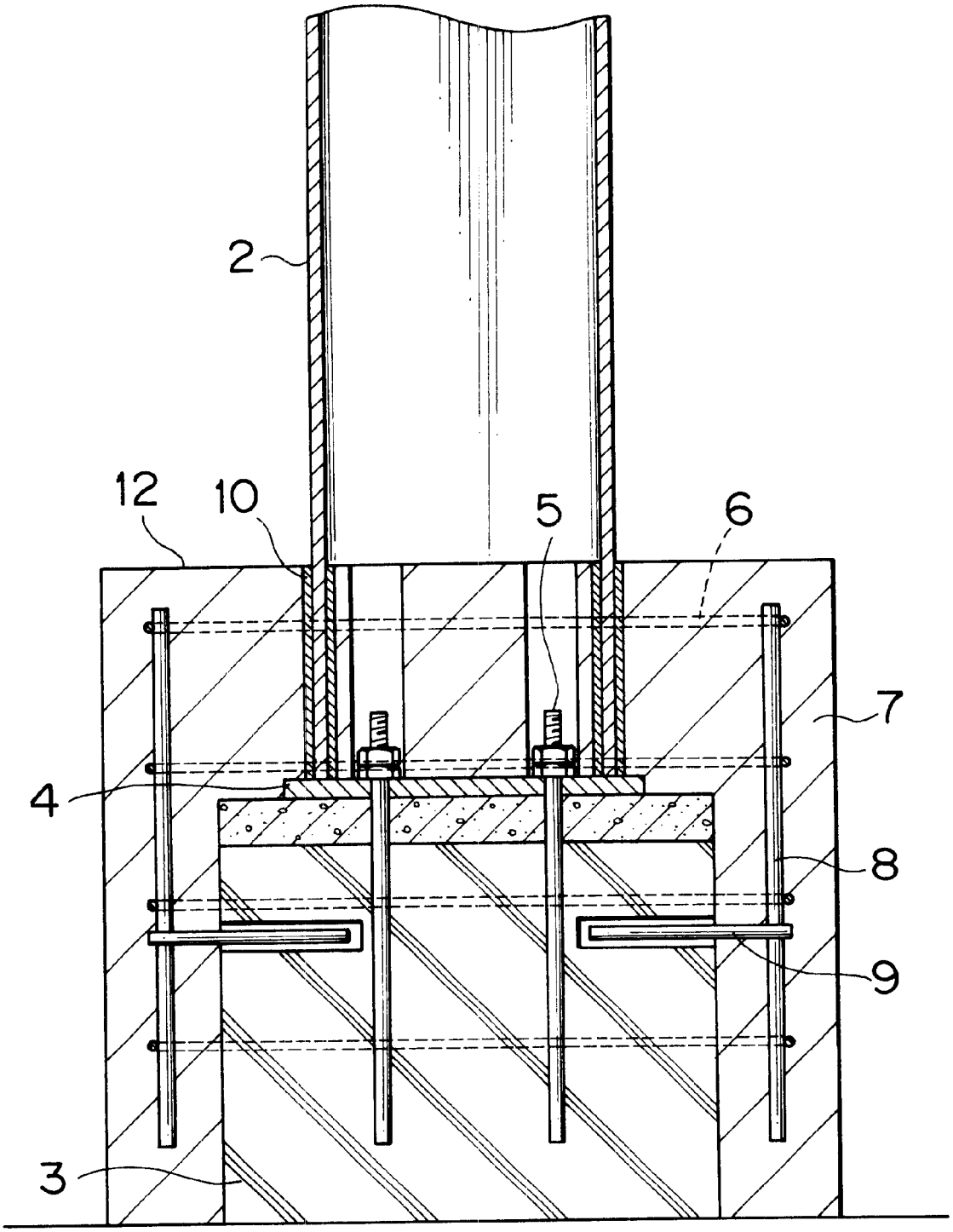
FIG. 4 is an enlarged front view of a column base in a case where a column base of a bed for piping system is reinforced with a root wrapping type reinforcement construction.
Figure 5:
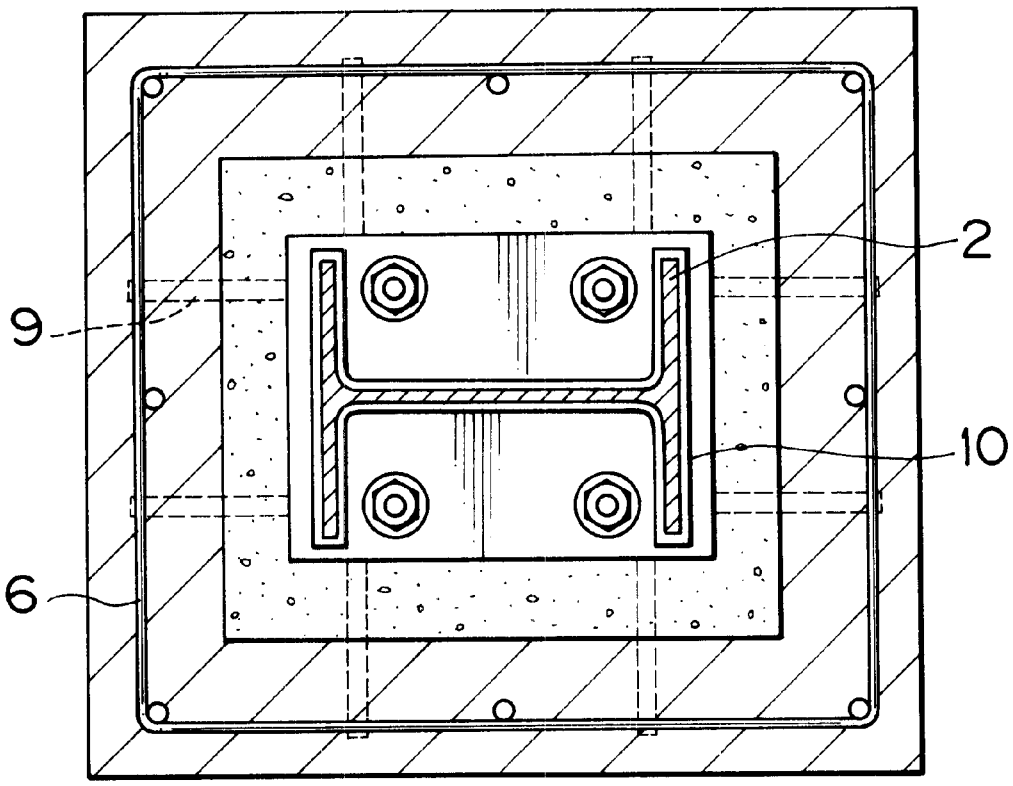
FIG. 5 is an enlarged sectional view of a column base in a case where a column base of a bed for piping system is reinforced with a root wrapping type reinforcement construction.

FIG. 4 is an enlarged front view of the column base in a case where the column base of the bed 1 for piping system is reinforced with a root wrapping type reinforcement construction, and FIG. 5 is an enlarged sectional view of the column base in a case where the column base of the bed 1 for piping system is reinforced with a root wrapping type reinforcement construction. A work procedure for a root wrapping member 12 will be described below with reference to FIG. 4. To form the root wrapping member 12, anchor bolts 9 for anchoring the root wrapping member 12 to the foundation 3, and rising reinforcing bars 8 and hoop reinforcing bars 6 placed at the outer periphery of the foundation 3 are first arranged. Then, after forms having a clearance 10 around the steel column 2 are provided, concrete is placed. Next, by removing the forms embedded around the steel column 2, the clearance 10 is formed around the steel column 2. The clearance 10 thus formed is filled with a predetermined filler (for example, vibration proof rubber), which is selected as necessary, by which a root wrapping reinforcement construction in accordance with this embodiment is formed.

Figure 6:
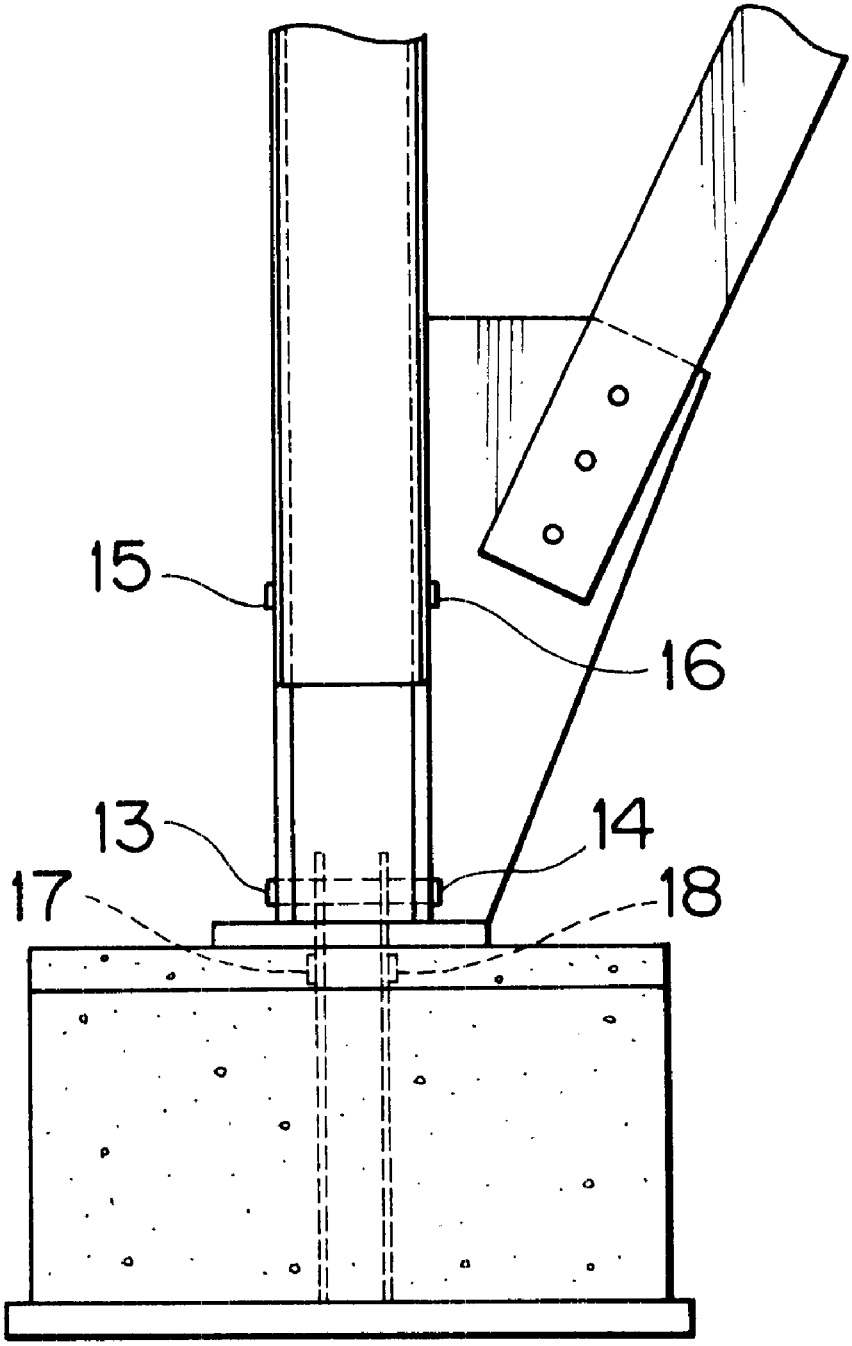
FIG. 6 is a view showing a column base of a bed for piping system before being reinforced, which was used for a seismic test, in which positions where resistant-wire strain gauges are installed are shown.
Figure 7:
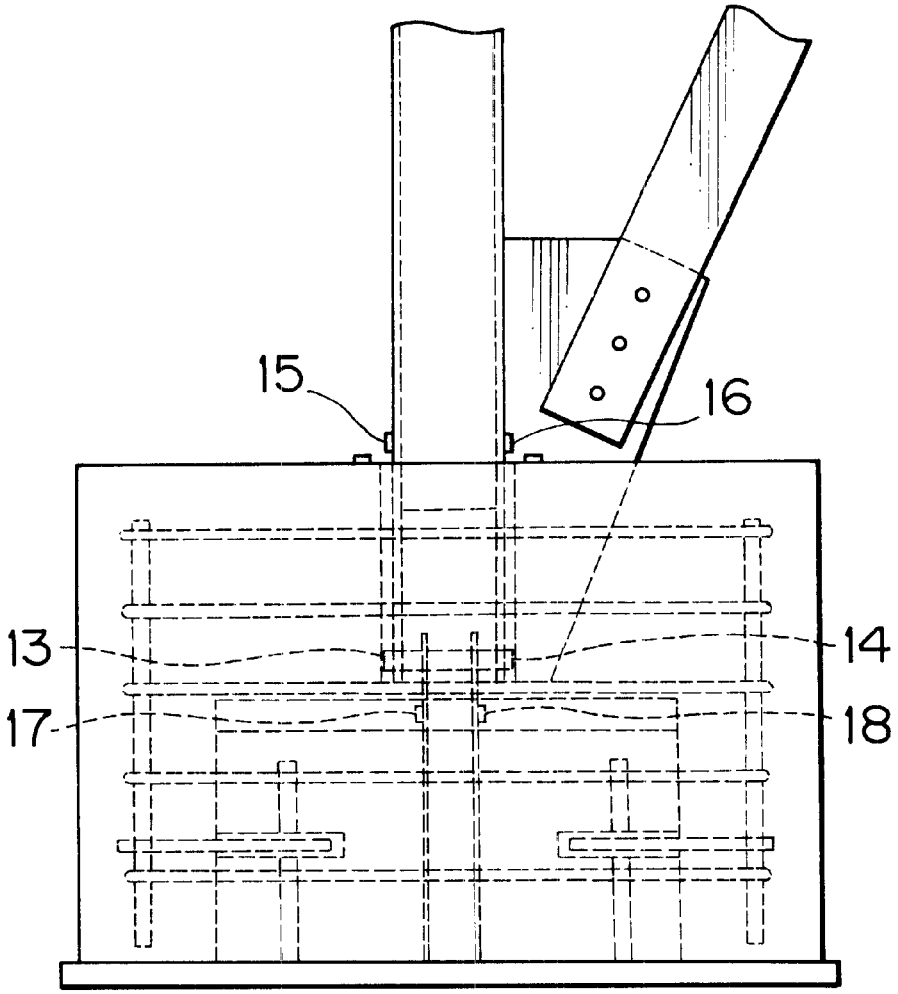
FIG. 7 is a view showing a column base of a bed for piping system after being reinforced, which was used for a seismic test, in which positions where resistant-wire strain gauges are installed are shown.

Next, a seismic test for the bed 1 for piping system having the root wrapping reinforcement construction in accordance with this embodiment will be described with reference to FIGS. 6 to 8. FIG. 6 shows the installation positions of resistant-wire strain gauges 13 to 18 which are installed on the column base of the bed 1 for piping system before being reinforced, which was used for the seismic test, and FIG. 7 shows the installation positions of resistant-wire strain gauges 13 to 18 which are installed on the column base of the bed 1 for piping system after being reinforced, which was used for the seismic test.

Figure 8:
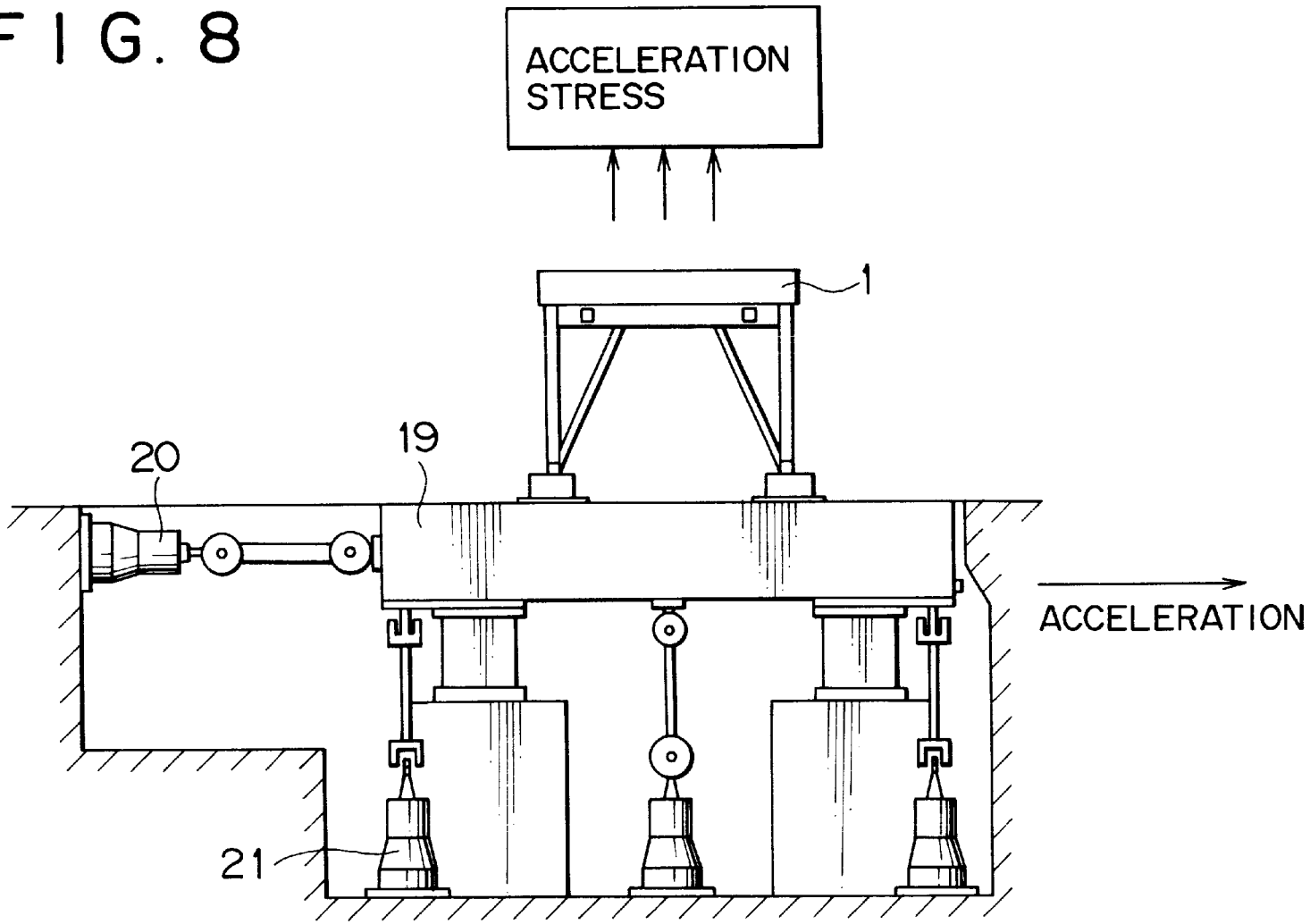
FIG. 8 is a view showing a bed for piping system placed on a seismic testing set.

FIG. 8 shows a seismic testing set. In the seismic test, the bed 1 for piping system, which is a test specimen, is placed on a shaking table 19, and excitation of seismic waves is effected by using a vibration exciter (horizontal) 20 and a vibration exciter (vertical) 21. During the excitation, acceleration and stress are measured at some portions on the test specimen. Specifically, the bed 1 for piping system, which is a test specimen, was placed on the seismic shaking table, and excitation was effected with Elcentro seismic waves and strong-motion seismograph recorded waveforms, by which the maximum response values at portions on the test specimen were determined. The input seismic waves used in the experiment were used by converting the time axis and acceleration in accordance with the similarity rule.

FIG. 9 shows excitation conditions in excitation of seismic waves. The seismic waves used for excitation were Elcentro waves, and also excitation was effected with typical seismic waves observed by an on-site strong-motion seismograph. For the Elcentro waves, an input acceleration was changed substantially at three stages (0.3 to 0.9G), and the excitation was effected in the horizontal direction and in two directions horizontal and vertical, simultaneously.

The acceleration was measured by using a strain gauge type accelerator. The accelerators were installed at 16 points on the top of the bed and 6 points on the base of the bed, a total of 22 points, so that the vibration mode and maximum response value in each direction of the bed for piping system can be measured. For the stress, the bending stress of the column base and base plate and the tensile stress of the anchor bolt were measured by using a resistant-wire strain gauge.

For the stress measurement for the column base and anchor bolt, a uniaxial gauge was used, whereas for the stress measurement for the base plate, a triaxial gauge was used. The number of measurement positions were 8 on the column bases, 30 on the base plates, 16 on the anchor bolts, and 10 on the root wrapping concrete portions. Examples of measurement positions are shown in FIGS. 6 and 7.

Next, the experimental results will be explained with reference to FIG. 10, which represents a relationship between the input acceleration and response acceleration and the stress (Y-direction excitation) for the bed for piping system. First, the purpose of the seismic experiment will be described with reference to FIG. 2. When input acceleration corresponding to the seismic force is applied to the bed 1 for piping system, the bed 1 for piping system is deformed according to the input acceleration, so that a corresponding stress is created. The created stress is transmitted from the column member 2 to the foundation 3 via the anchor bolts 5 when there is no root wrapping reinforcement. At this time, since the column member 2 is designed and installed on the foundation 3 under a condition close to a pin support, the stress caused by bending deformation and transmitted from the column member 2 to the foundation 3 remains having a relatively small value.

On the other hand, when the root wrapping reinforcement is effected without a buffering portion being provided as in this embodiment shown in FIG. 4 to increase the earthquake resistant performance of the bed 1 for piping system, the column member 2 is restrained via the foundation 3 and the root wrapping member 12, so that the column member 2 is not installed on the foundation 3 under a condition close to a pin support. Therefore, the aforementioned stress caused by bending deformation and transmitted from the column member 2 to the foundation 3 increases.

Prior to the formal seismic experiment, a seismic experiment was carried out by using a test specimen in which the root wrapping reinforcement was effected on the bed 1 for piping system without the buffering portion being provided. The result was that the foundation portion was ruptured in spite of the fact that the root wrapping reinforcement had been effected. The reason for this is thought to be that since the column member 2 is firmly connected to the foundation 3 as described above, the stress caused by bending deformation and transmitted from the column member 2 to the foundation 3 increases, so that the stress transmitted to the foundation 3 is not decreased despite the root wrapping reinforcement.

Thereupon, this embodiment provides a construction in which by providing a buffering portion 10 at a portion where the root wrapping member 12 faces the column member 2, deformation caused by an external force applied to the column member 2 is allowed. For this construction, the column member 2 is not firmly fixed to the foundation 3 by the reinforcement effected by using the root wrapping member 12, and the aforementioned condition close to a pin support can be held.

The following is a detailed description of the buffering portion. As shown in FIGS. 4 and 5, in this embodiment, the buffering portion 10 with a clearance width of about 10 to 15 mm was provided around the column member 2, and further the buffering portion 10 was filled with an asphalt mastic molded joint plate (trade name: AOI Elastite manufactured by AOI Chemical Incorporated), which is a joint material for concrete structures, as a filler that has a high compressive strength and less expansion and contraction, and can absorb stresses caused by bending deformation.

The filler is not limited to the aforementioned material, and other materials that are deformed elastically or plastically can be used, such as various kinds of rubber including vibration proof rubber, polymeric materials including epoxy resin, metallic materials and metallic alloy materials including an aluminum plate, aluminum alloy, and zinc plate, and materials made from petroleum or coal including asphalt.

Specifically, the filler may be any material that can absorb bending moment generated on the steel column base when an external force is applied. In effect, any construction may be used in which the side face of the lower part of the column base is not connected directly to the root wrapping member; a clearance is provided therebetween and is filled with the filler, whereby the connecting force at the interface between the side face of the lower part of the column base and the root wrapping member is decreased, and bending deformation of the steel column base caused by the application of an external force is allowed; and most of the bending moment generated on the steel column base is absorbed by the filler and the root wrapping member, whereby the bending moment transmitted from the column base to the foundation is decreased greatly. Also, a member constituting such a construction, which has any shape, may be used.

Further, the root wrapping member 12 provided with the buffering portion 10 plays a role in preventing the foundation 3 from being ruptured by a stress transmitted from the column member 2 when the root wrapping reinforcement is not effected. This role is to decrease the stress transmitted from the column member 2 to the foundation 3 through the buffering portion 10 and the root wrapping member 12. By this role played by the root wrapping member 12, the stress transmitted to the foundation 3 is decreased. Therefore, the stress born by the foundation 3 is decreased, so that the foundation 3 is prevented from being ruptured.

Next, the results of seismic experiment will be described with reference to FIG. 10. FIG. 10 shows an example of result of test in which the effect of the root wrapping reinforcement was investigated using the bed 1 for piping system without root wrapping reinforcement (○ and ● marks in the figure) and the bed 1 for piping system with root wrapping reinforcement(□ and ■ marks in the figure). The abscissas represent the input acceleration representing the magnitude of seismic force and the ordinates the stress created on the foundation 3. The stress created on the foundation 3 is represented by the maximum stress value obtained by the resistant-wire strain gauge 18 (see FIG. 7) installed on the anchor bolt 5.

Figure 10:
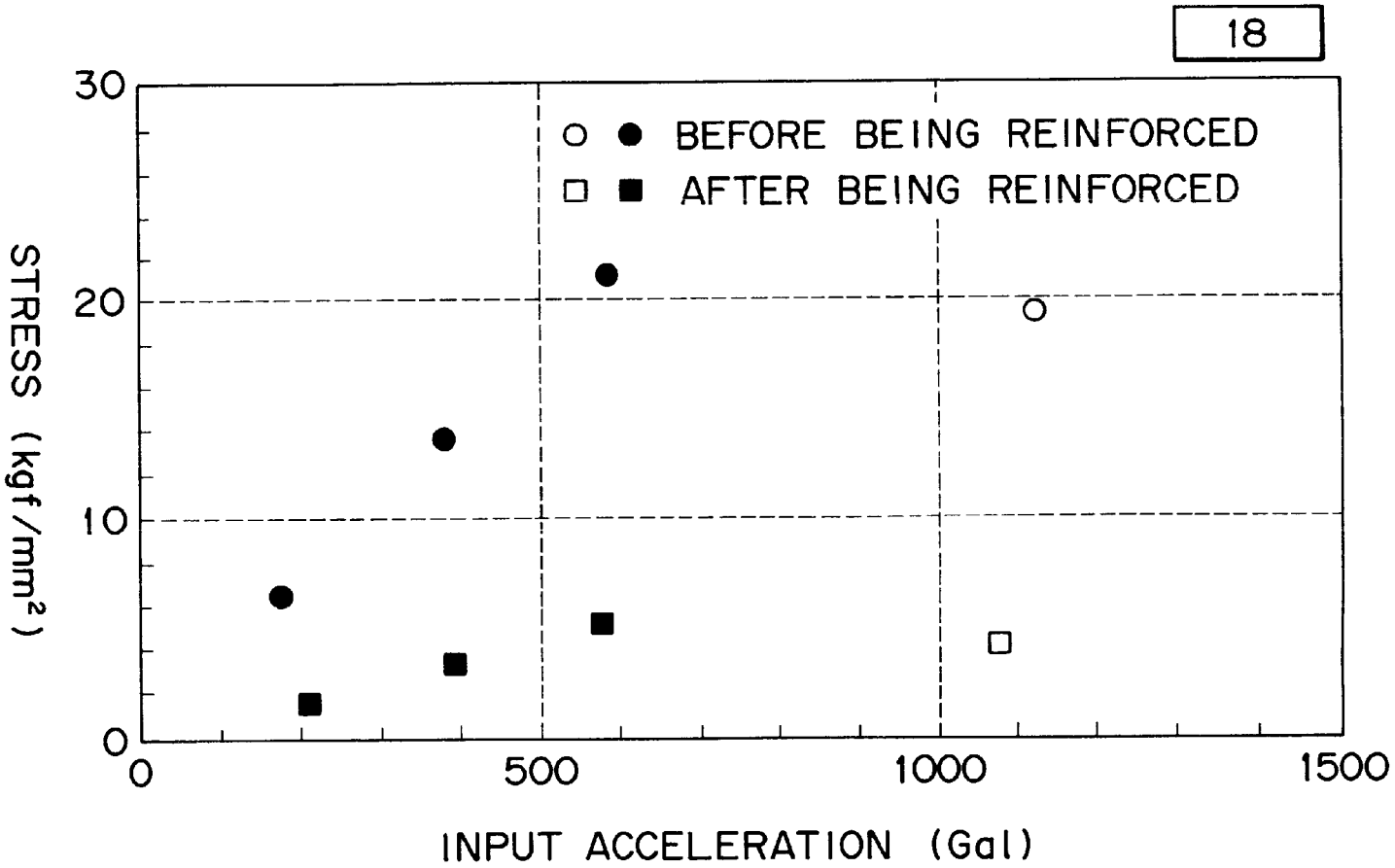
FIG. 10 is a chart showing seismic test results.

As can be seen in FIG. 10, there is found a tendency for the maximum stress value to increase with increasing input acceleration. Also, a stress also occurs on the bed 1 for piping system without rootwrapping reinforcement shown in the figure. This indicates that since the column member 2 is connected to the foundation 3 with the anchor bolts 5 as shown in FIGS. 2 and 3, an ideal pin support is not provided, so that a bending stress is transmitted. As is apparent from FIG. 10, the stress on the bed 1 for piping system with root wrapping reinforcement decreases to about one-tenth of the stress transmitted to the foundation 3 on the bed 1 for piping system without root wrapping reinforcement. The reason for this is as described above.

The examination of the test specimen after the seismic test revealed the effect of the root wrapping reinforcement. Specifically, although on the bed 1 for piping system without root wrapping reinforcement, the anchor bolts 5 for the column base 2 were pulled out and the base plate 4 floated, the floating of the base plate 4 was eliminated by effecting root wrapping reinforcement using concrete.

Other Embodiments

Although an example in which aseismic reinforcement is effected on a steel column base having a prismatic shape has been described in the above-described embodiment, the present invention is not limited to this, and can be applied to a steel column base of any other configuration, for example, a steel column base having a cylindrical shape.

Also, mention has not especially been made of the foundation in the above-described embodiment. For the foundation, unreinforced concrete, reinforced concrete, steel framed reinforced concrete, and other concrete materials may be used, or a member consisting of steel may be used. Also, an example in which a bed for piping system is used as a structure having steel column bases has been described in the above-described embodiment. However, the present invention is not limited to this, and can be applied to a structure of any other construction, for example, a general civil engineering structure.

Further, the present invention is not limited to the above-described embodiment. The above-described embodiment is one example, and any construction having the same configuration as the technical concept described in the claims of the present invention and having the similar operation and effects is embraced by the technical scope of the present invention.

In effect, any construction may be used in which the side face of the lower part of the column base is not connected directly to the root wrapping member; a clearance is provided therebetween and is filled with the filler, whereby the connecting force at the interface between the side face of the lower part of the column base and the root wrapping member is decreased, and bending deformation of the steel column base caused by the application of an external force is allowed; and most of the bending moment generated on the steel column base is absorbed by the filler and the root wrapping member, whereby the bending moment transmitted from the column base to the foundation is decreased greatly. Also, a member constituting such a construction, which has any shape, may be used.

Also, the material of the filler is not limited to vibration proof rubber. Other materials that are deformed elastically or plastically can be used, such as various kinds of rubber, polymeric materials including epoxy resin, metallic materials and metallic alloy materials including an aluminum plate, aluminum alloy, and zinc plate, and materials made from petroleum or coal including asphalt. In effect, any material that can absorb bending moment generated on the steel column base when an external force is applied can be used.

Further, in the present invention, the clearance may be a void without filling the clearance with a filler. In this case, as compared with the case where the clearance is filled with a filler, the effect of the void in absorbing the bending moment on the steel column base when an external force is applied decreases. However, as compared with the case where the clearance is filled with a filler, the allowable range of bending deformation of the steel column base generated by the application of an external force is widened by making the best use of the void. As a result, the bending moment generated on the steel column base and transmitted from the column base to the foundation is decreased by the void. By the above-described two effects, the case where the clearance is made a void can achieve the same effect as that in the case where the clearance is filled with a filler.

What is claimed is:

1. A root wrapping type aseismic reinforcement construction in which a base of a column member erected on a foundation member is reinforced with a root wrapping member, comprising:

a buffering portion provided between the base of said column member and said root wrapping member; wherein said buffering portion is formed such that a constant clearance or gap of about 10 to 15 mm is defined between a periphery of the column member and the periphery of the buffering portion.

2. The root wrapping type aseismic reinforcement construction according to claim 1, wherein said buffering portion is a clearance provided between said column base and said root wrapping member.

3. The root wrapping type aseismic reinforcement construction according to claim 1, wherein said buffering portion is a clearance provided between said column base and said root wrapping member and further filled with a filler.

4. The root wrapping type aseismic reinforcement construction according to claim 3, wherein said root wrapping member and said filler regulate bending moment generated when said column member is deformed.

5. The root wrapping type aseismic reinforcement construction according to claim 3, wherein said filler is either an elastically deformed material including vibration proof rubber or an elastic element including a spring.

6. A root wrapping type aseismic reinforcement construction in which a base of a column member erected on a foundation member is reinforced with a root wrapping member, comprising:

a buffering portion provided between the base of said column member and said root wrapping member;

wherein said buffering portion is a clearance provided between said column base and said root wrapping member and further filled with a filler; and wherein said filler is either a plastically deformed material including either a metallic material or a metallic alloy or a plastically deformed structural element.

7. The root wrapping type aseismic reinforcement construction according to any one of claims 1 to 5, wherein said root wrapping member is a reinforced concrete root wrapping member formed by placing reinforced bars at the outer periphery of said column base and the upper end portion of said foundation member, by placing outer winding hoops at the outer periphery of said reinforcing bars, and by placing concrete in a space within said outer winding hoops.

8. The root wrapping type aseismic reinforcement construction according to any one of claims 1 to 5, wherein a bend constraining force caused on said column base by an external force is relieved, and bending moment generated on said column base is regulated, thereby reinforcing said foundation member; wherein the root wrapping member is provided with a buffering portion at its portion opposed to the column member, thereby allowing deformation of the root wrapping member when an external force is imparted thereon.

9. A root wrapping type aseismic reinforcement method in which a base of a column member erected on a foundation member is reinforced with a root wrapping member, comprising:

forming a constant clearance or gap of about 10 to 15 mm defined between a periphery of the column member and a portion of the root wrapping member facing the column member;

a buffering step of regulating bending moment generated on the base of said column member by the application of an external force to said column member at a portion between said base and said root wrapping member; and a regulating step of further regulating the bending moment by absorbing the bending moment regulated in said buffering step.

10. A root wrapping type aseismic reinforcement method in which a base of a column member erected on a foundation member is reinforced with a root wrapping member, comprising:

a clearance forming material providing the step of providing a forming material for forming a clearance at the outer periphery of said base facing said root wrapping member;

a fixing step of placing reinforcing bars at the outer periphery ranging from the base of said column member to the upper end portion of said foundation member, placing outer winding hoops at the outer periphery of said reinforcing bars, and fixing said reinforcing bars to the upper end portion of said foundation member;

a member forming step of placing concrete in a space within the outerwinding reinforcing bars fixed in said fixing step to form a reinforced concrete root wrapping member, including said forming material provided in said clearance forming material providing step; and a clearance forming step of forming a constant clearance or gap of about 10 to 15 mm is defined between a periphery of the column member and the buffering portion by removing said forming material from said reinforced concrete root wrapping member formed in said member forming step.

11. The root wrapping type aseismic reinforcement method according to claim 10, further comprising a filling step of filling said clearance formed in said clearance forming step with a filler.

12. The root wrapping type aseismic reinforcement construction according to claim 3, wherein said filler is either a plastically deformed material including either a metallic material or a metallic alloy or a plastically deformed structural element.

13. The root wrapping type aseismic reinforcement construction according to claim 6, wherein said root wrapping member is a reinforced concrete root wrapping member formed by placing reinforced bars at the outer periphery of said column base and the upper end portion of said foundation member, by placing outer winding hoops at the outer periphery of said reinforcing bars, and by placing concrete in a space within said outer winding hoops.

14. The root wrapping type aseismic reinforcement construction according to claim 6, wherein a bend constraining force caused on said column base by an external force is relieved, and bending moment generated on said column base is regulated, thereby reinforcing said foundation member; wherein the root wrapping member is provided with a buffering portion at its portion opposed to the column member, thereby allowing deformation of the root wrapping member when an external force is imparted thereon.

15. The root wrapping type aseismic reinforcement construction according to claim 7, wherein a bend constraining force caused on said column base by an external force is relieved, and bending moment generated on said column base is regulated, thereby reinforcing said foundation member; wherein the root wrapping member is provided with a buffering portion at its portion opposed to the column member, thereby allowing deformation of the root wrapping member when an external force is imparted thereon.

* * * * *